US006234841B1

(12) United States Patent
Chang et al.

(10) Patent No.: US 6,234,841 B1
(45) Date of Patent: May 22, 2001

(54) METAL SHIELD AND CONNECTOR BODY ARRANGEMENT OF AN ELECTRIC CONNECTOR

(75) Inventors: Chih-Kai Chang, Sanchung; Chin-Hsien Hsu, Taipei, both of (TW)

(73) Assignee: Tekcon Electronics Corp., Taipei Hsien (TW)

( * ) Notice: Subject to any disclaimer, the term of this patent is extended or adjusted under 35 U.S.C. 154(b) by 0 days.

(21) Appl. No.: 09/468,097

(22) Filed: Dec. 21, 1999

(51) Int. Cl.[7] ..... H01R 13/648
(52) U.S. Cl. ..... 439/609; 439/607
(58) Field of Search ..... 439/609, 607, 439/939, 92

(56) References Cited

U.S. PATENT DOCUMENTS 5,178,562 * 1/1993 Ermini ..... 439/609
5,288,248 * 2/1994 Chen ..... 439/609
5,913,698 * 6/1999 Keng ..... 439/609
5,984,727 * 11/1999 Wu et al. ..... 439/607

* cited by examiner

*Primary Examiner*—Paula Bradley
*Assistant Examiner*—Antoine Ngandjui
(74) *Attorney, Agent, or Firm*—Robert E. Bushnell, Esq.

(57) ABSTRACT

A metal shield and connector body arrangement, which includes a connector body, a metal shield made by bending a crossed metal sheet into a casing and covered on the connector body, and a metal spring plate mounted between the front side wall of the connector body and the metal shield, the metal spring plate having two protruding grounding strips respectively extended out of respective insertion slots at the metal shield for connection to the metal shell of the mainframe of a computer, and a locating arm disposed at each of two distal ends thereof respectively engaged into a respective annular groove around a respective receptacle at the connector body, the locating arm having a plurality of curved locating strips with a respective raised retaining portion for engagement with the metal shell of an external electric plug being inserted through a hole at the metal shell of the mainframe of the computer and a through hole at the metal shield into connection with one receptacle at the connector body.

6 Claims, 7 Drawing Sheets

METAL SHIELD AND CONNECTOR BODY ARRANGEMENT OF AN ELECTRIC CONNECTOR

BACKGROUND OF THE INVENTION

The present invention relates to an electric connector, and more specifically to a metal shield and connector body arrangement for an electric connector, which effectively eliminates external electromagnetic waves, positively guides static electric charges to the ground terminal.

A variety of computer peripheral apparatus (such as keyboard, mouse, modem, digitizer, etc.) may be used with a computer. The circuit (master) board in the mainframe of a computer must be provided with a variety of connectors, so that different computer peripheral apparatus can be installed. During signal transmission, noises may be produced at the electric connectors on the circuit board. These noises may come from ambient electromagnetic waves, or static electricity in the electric connectors. In order to eliminate the interference of noises, an electric connector must be provided with metal shielding means. FIGS. 7 and 8 show an electric connector according to the prior art. This structure of electric connector comprises a connector body, and a metal shielding structure mounted on the electrically insulative shell of the connector body. The metal shielding structure is comprised of two metal shields, and a grounding plate. This metal shielding structure is somewhat functional, however its installation procedure is complicated, and its manufacturing cost is high.

SUMMARY OF THE INVENTION

The present invention has been accomplished under the circumstances in view. It is one object of the present invention to provide a metal shield and connector body arrangement for an electric connector, which effectively eliminates the interference of external electromagnetic waves and internal static electricity. It is another object of the present invention to provide a metal shield and connector body arrangement for an electric connector, which is inexpensive to manufacture. To achieve these and other objects of the present invention, there is provided a metal shield and connector body arrangement, which comprises a metal shield covered on a connector body, and a metal spring plate retained between the connector body and the metal shield. The metal shield is comprised of a crossed metal sheet bent into a hollow case having a bottom open side for covering on the connector body, and a protruding grounding strip for connection to a grounding terminal on a circuit board to which the connector body is connected. The metal spring plate comprises two protruding grounding strips respectively extended out of respective insertion slots at the metal shield for connection to the metal shell of the mainframe of the computer, and arched (or annular) locating arms respectively engaged into a respective annular groove at the front side wall of the connector body around a respective receptacle in the connector body for contact with the metal shell of an electric plug connector being connected to the connector body. The locating arms each comprise a plurality of locating strips with a respective raised retaining portion for positive contact with the metal shell of the electric plug connector installed in the connector body.

DETAILED DESCRIPTION OF THE PREFERRED EMBODIMENT

Figure 1:
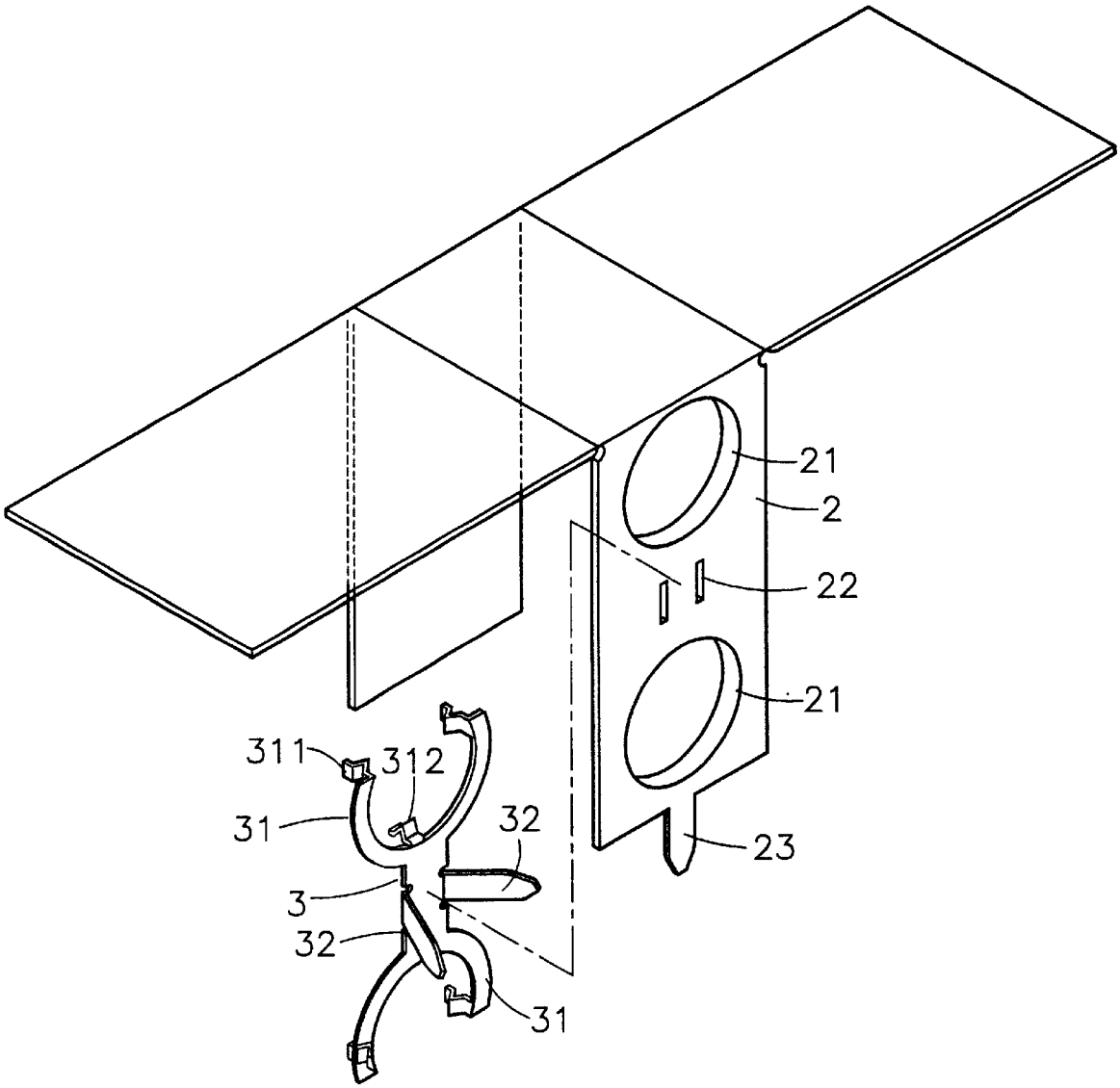
FIG. 1 is an exploded view of a part of the present invention, showing the structure of the metal shield and the metal spring plate.
Figure 2:
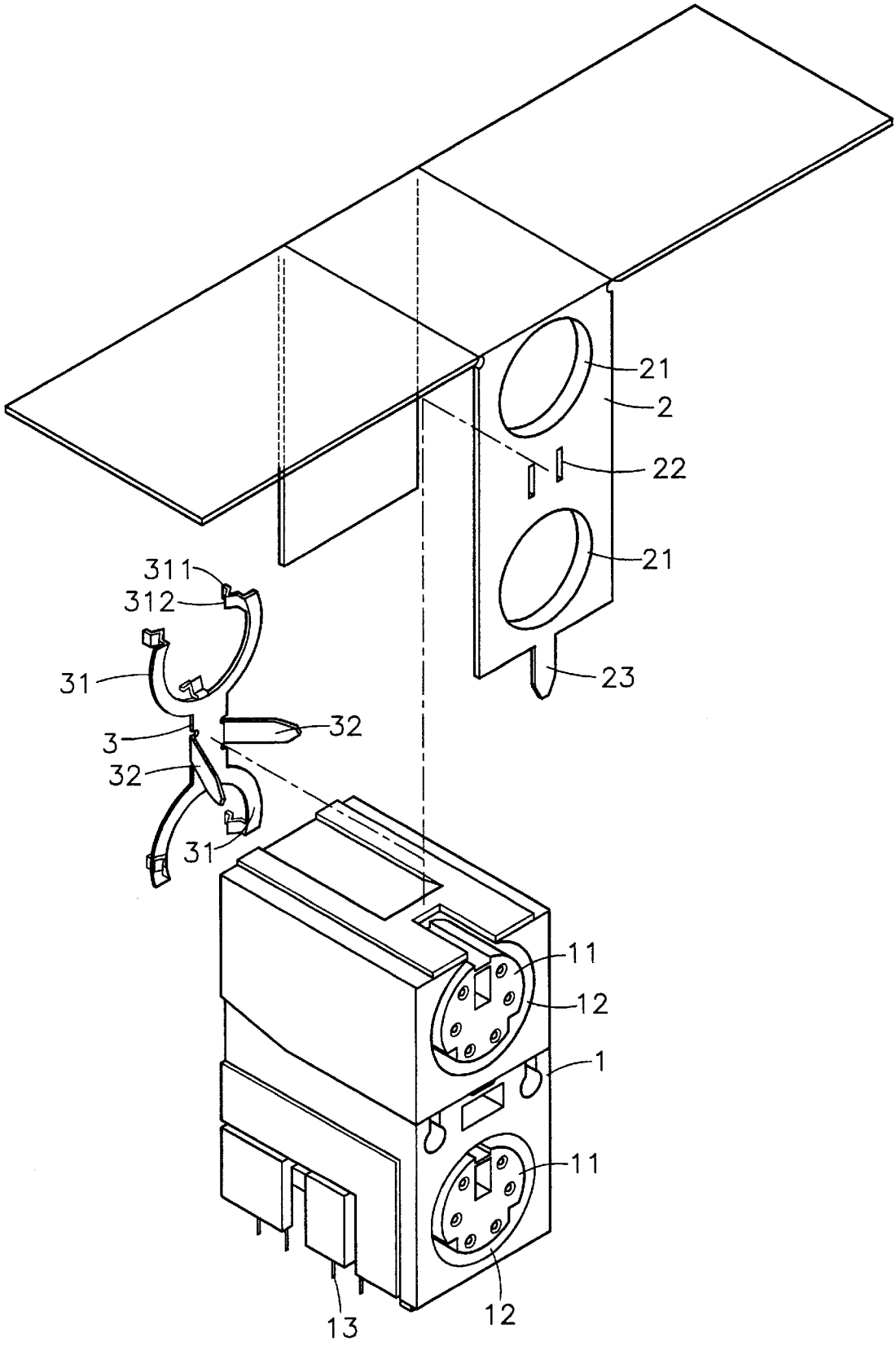
FIG. 2 is an exploded view of the present invention.

Referring to FIGS. 1 and 2, an electric connector is shown comprised of a connector body 1, a metal shield 2, and a metal grounding spring plate 3. The connector body 1 comprises two receptacles 11 at the front side thereof, two annular grooves 12 linked at the front side and respectively disposed around the receptacles 11, and a plurality of pins 13 protruded from the bottom side thereof. The metal shield 2 is made by stamping a metal sheet into a substantially crossed shape having a, and bent into shape for covering on the top side, front side, rear side, and two opposing lateral sides of the connector body 1, having two through holes 21 at the front panel thereof corresponding to the annular grooves 12 at the front side of the connector body 1, two insertion slots 22 arranged in parallel through the front panel between the through holes 21, and a protruding grounding strip 23 extended from one end of the front panel. The grounding spring plate 3 comprises two projecting grounding strips 32 bilaterally disposed on the middle, and two smoothly arched locating arms 31 formed integral with two distal ends thereof. The smoothed arched locating arms 31 each have two distal ends respectively terminated in a respective curved locating strip 311. The curved locating strips 311 of the smoothed arched locating arms 31 of the grounding spring plate 3 each have a raised retaining portion 312 at the end.

Figure 3:
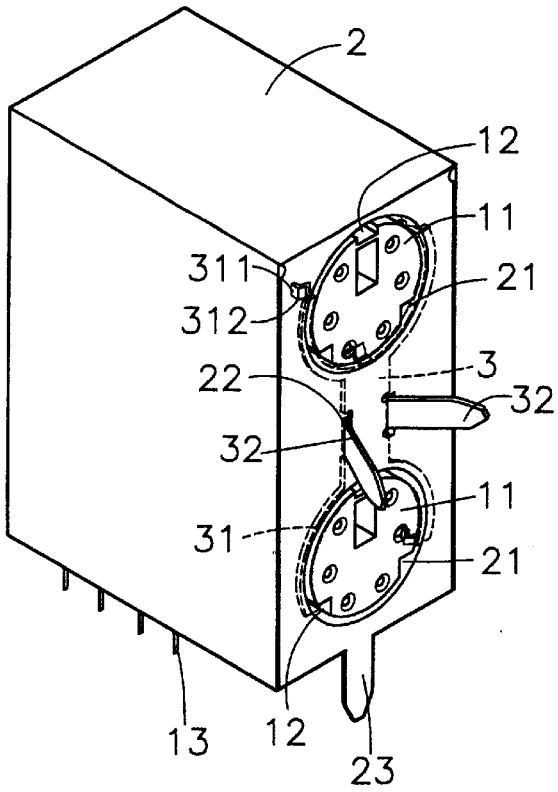
FIG. 3 is a perspective view of the present invention, showing the metal shield and the metal spring plate fastened to the connector body.
Figure 4:
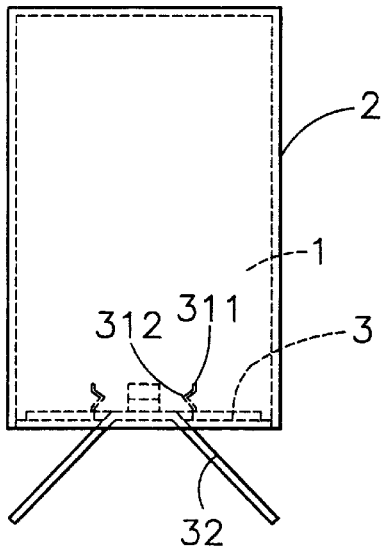
FIG. 4 is a top plain view of FIG. 3.

The assembly process of the electric connector is outlined hereinafter with reference to FIGS. 3 and 4 and FIG. 2 again. At first, the grounding spring plate 3 is attached to the backside wall of the metal shield 2, permitting the projecting grounding strips 32 to be respectively inserted through the insertion slots 32 at the metal shield 2. After insertion of the projecting grounding strips 32 into the insertion slots 32, the projecting grounding strips 32 are clamped on the peripheral edge at each insertion slot 22 to secure the grounding spring plate 3 to the metal shield 2 firmly. The metal shield 2 is then bent into shape (the shape of a hollow rectangular case), and then fastened with the grounding spring plate 3 to the connector body 1, enabling the smoothly arched locating arms 31 to be respectively engaged into the annular grooves 12 at the connector body 1 around each receptacle 11, and the curved locating strips 311 to be respectively inserted into the inside of the connector body 1. After installation of the electric connector of the present invention in a circuit board inside an electronic apparatus, for example the mainframe of a computer (not shown), the pins 13 of the connector body 1 are respectively connected to respective contact holes at the circuit board for signal transmission and grounding, the protruding grounding strip 23 of the metal shield 2 is fastened to a grounding terminal at the circuit board, and the projecting grounding strips 32 of the metal shield 2 are respectively connected to the metal shell of the mainframe of the computer. Therefore, the metal shield 2 and the metal spring plate 3 positively discharge static electricity from the electric connector to the ground terminal during the operation of the computer, and effectively protect the electric connector against external EMI (electromagnetic interference). Further, when an electric plug connector (from, for example, a computer keyboard or mouse) is inserted into one through hole 21 at the metal shield 2 and connected to the corresponding receptacle 11, the tubular metal shell of the electric plug connector is forced into engagement with the raised retaining portion 312 at each curved locating strip 311, and therefore the installed electric plug connector is firmly secured in place and positively connected to the receptacle 11.

Figure 5:
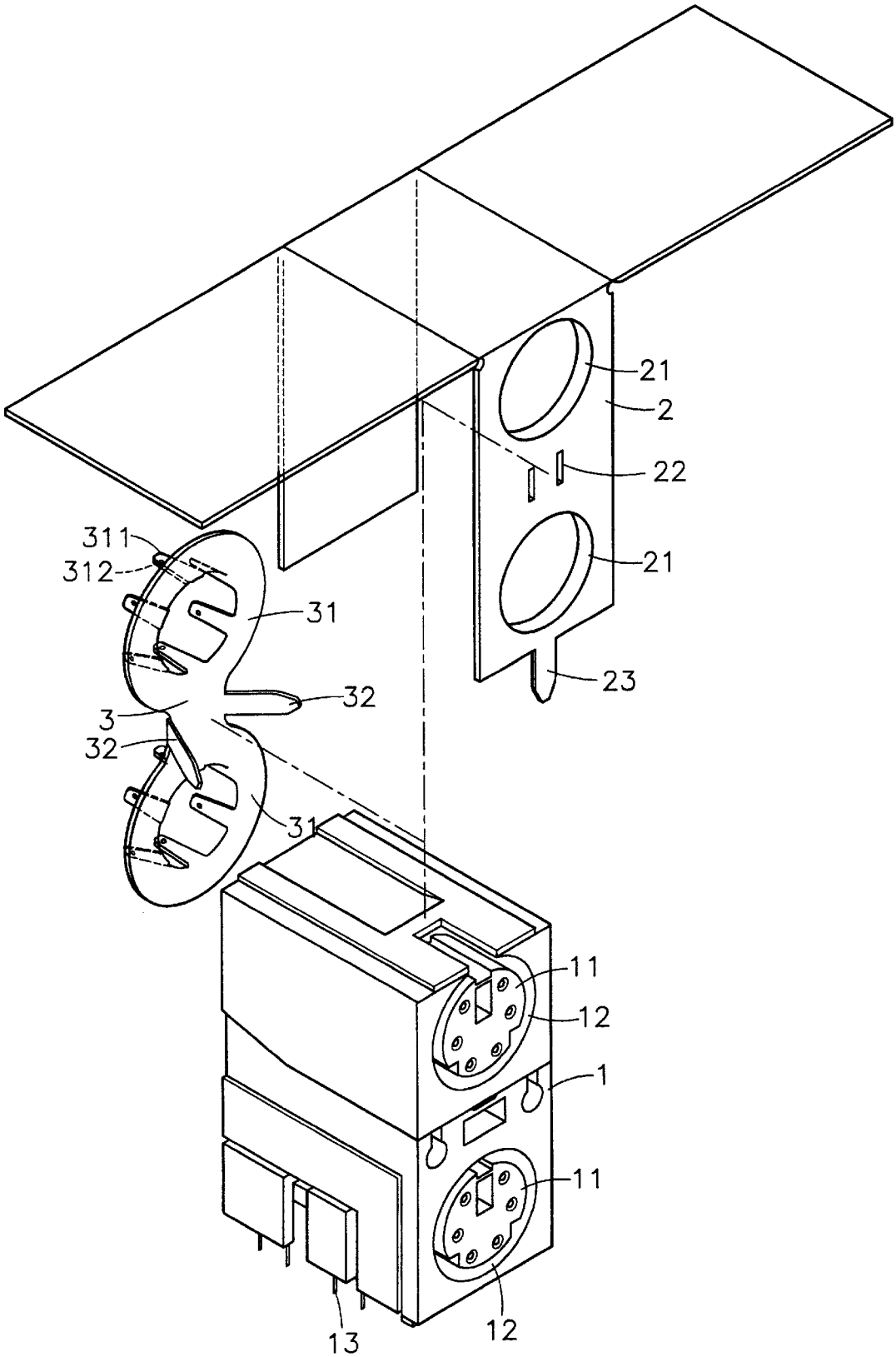
FIG. 5 is an exploded view of an alternate form of the present invention.
Figure 6:
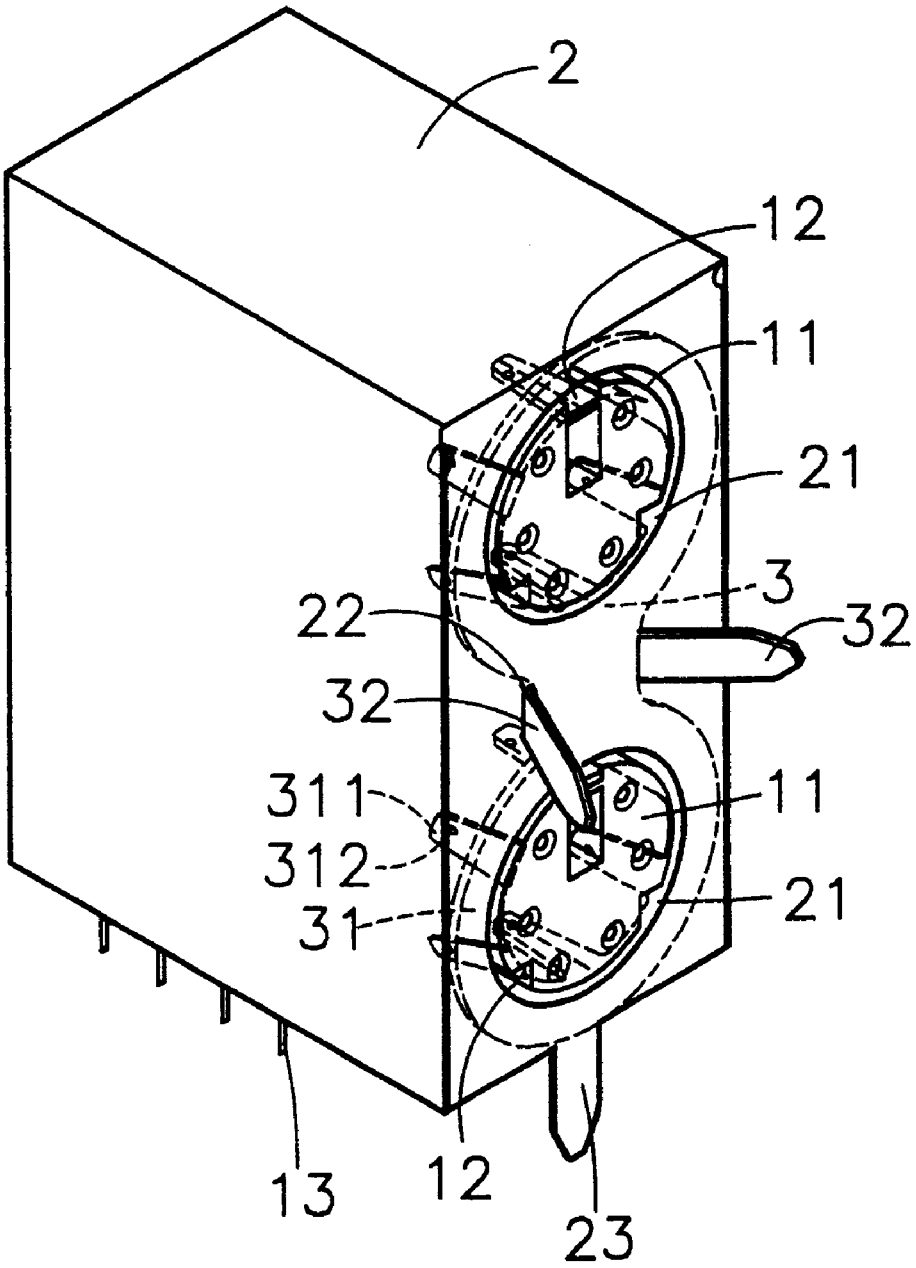
FIG. 6 is a perspective view showing the alternate form of FIG. 5 assembled.
Figure 7:
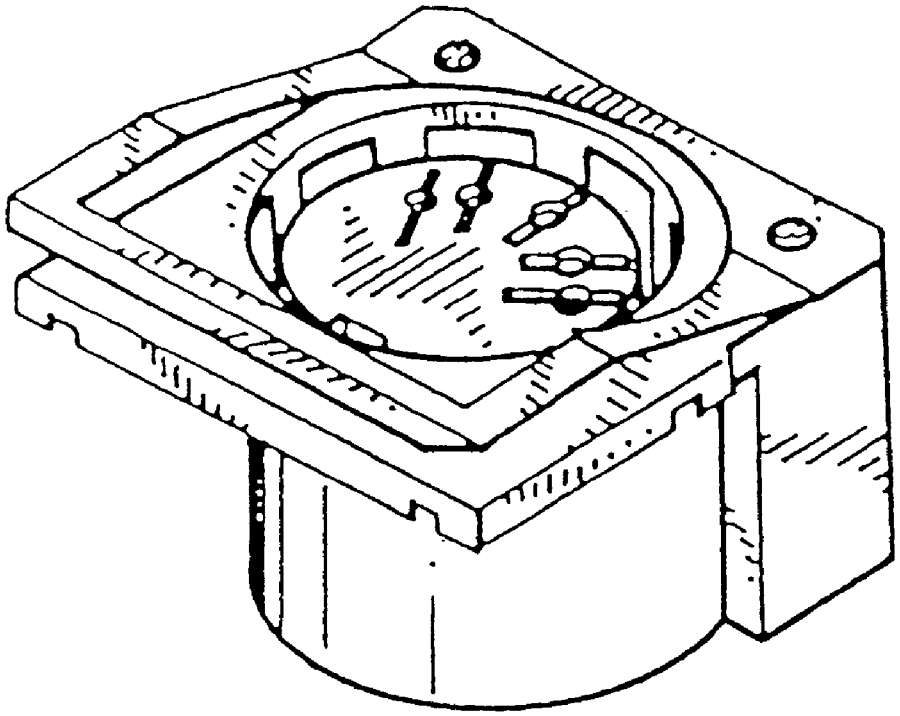
PRIOR ART FIG. 7
FIG. 7 is a perspective view of an electric connector according to the prior art.
Figure 8:
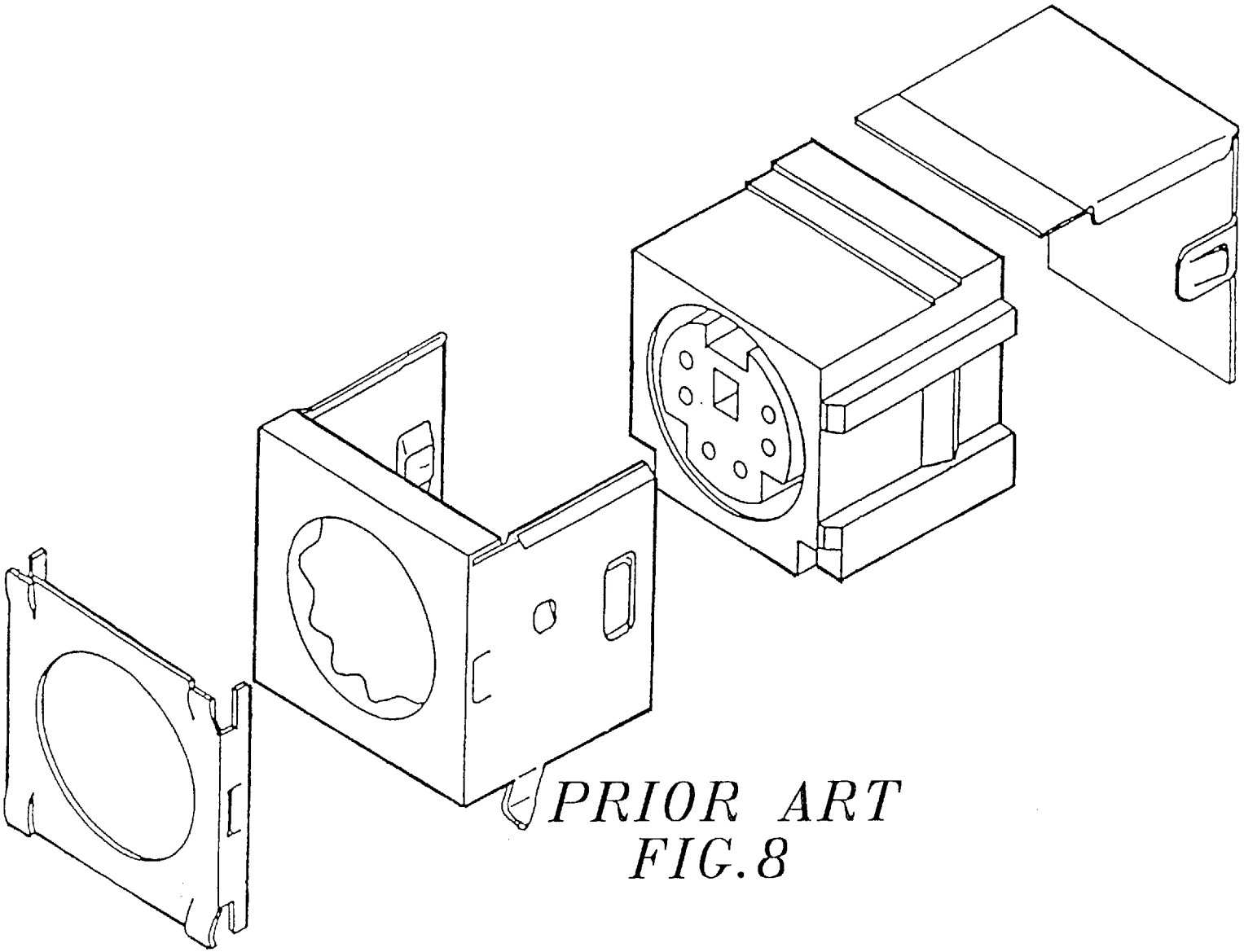
PRIOR ART FIG. 8
FIG. 8 is an exploded view of the electric connector shown in FIG. 7.

FIG. 5 and 6 show an alternate form of the present invention. According to this alternate form, the grounding spring plate 3 comprises twp projecting grounding strips 32 bilaterally disposed on the middle, two annular locating arms 31 formed integral with two distal ends thereof, a plurality of protruding locating strips 311 respectively formed integral with the inner diameter of each annular locating arm 31, and a plurality of retaining portion 312 respectively raised from the protruding locating strips 311 remove from the annular locating arms 31. The installation procedure of this alternate form is same as the embodiment shown in FIGS. from 1 through 4.

It is to be understood that the drawings are designed for purposes of illustration only, and are not intended for use as a definition of the limits and scope of the invention disclosed.

What the invention claimed is:

1. A metal shield and connector body arrangement comprising a connector body, said connector body having at least one receptacle at a front side wall thereof for receiving an external electric plug connector, at least one annular groove respectively provided at the front side wall around said at least one receptacle, and a plurality of bottom pins for connection to a circuit board, and a metal shield covering said connector body to eliminate electromagnetic interference, said metal shield comprising at least one through hole respectively provided at a front panel thereof and aligned with the at least one receptacle in said connector body, and a plurality of insertion slots, wherein a metal spring plate is mounted on the front side wall of said connector body and retained between said connector body and said metal shield, said metal spring plate, comprising a plurality of projecting grounding strips respectively extended out of said metal shield through said insertion slots for grounding, at least one locating arm respectively engaged into the at least one annular groove in said connector body around said at least one receptacle, a plurality of protruding locating strips respectively extended from said at least one locating arm and inserted into the inside of said connector body, and a plurality of retaining portions respectively raised from said protruding locating strips for engagement with a metal shell of an external electric plug connector being connected to said at least one receptacle.

2. The metal shield and connector body arrangement of claim 1 wherein the at least one locating arm of said metal spring plate each has a smoothly arched shape.

3. The metal shield and connector body arrangement of claim 1 wherein the at least one locating arm of said metal spring plate each has an annular profile.

4. The metal shield and connector body arrangement of claim 1 wherein said metal shield comprises a protruding grounding strip downwardly extended from the front panel at a bottom side for connection to a grounding terminal at a circuit board.

5. The metal shield and connector body arrangement of claim 1 wherein said metal shield is comprised of a cross-shape metal sheet bent into a casing having a bottom open side.

6. The metal shield and connector body arrangement of claim 1 wherein said metal spring plate comprises two protruding grounding strips bilaterally disposed and respectively inserted through a respective insertion slot of said metal shield.

* * * * *